US008327597B2

(12) United States Patent
Kuroiwa

(10) Patent No.: US 8,327,597 B2
(45) Date of Patent: Dec. 11, 2012

(54) CONSTRUCTION METHOD FOR WOODEN HOUSE AND WALL PANEL

(75) Inventor: Yoichiro Kuroiwa, Tokyo (JP)

(73) Assignees: Kuroiwa Kenzai Kenkyusho Co., Ltd., Tokyo (JP); Yoichiro Kuroiwa, Tokyo (JP)

( * ) Notice: Subject to any disclaimer, the term of this patent is extended or adjusted under 35 U.S.C. 154(b) by 250 days.

(21) Appl. No.: 12/626,334

(22) Filed: Nov. 25, 2009

(65) Prior Publication Data

US 2011/0179731 A1 Jul. 28, 2011

(30) Foreign Application Priority Data

Oct. 27, 2009 (JP) ..... 2009-246330

(51) Int. Cl.
*E04B 2/30* (2006.01)

(52) U.S. Cl. ..... 52/483.1; 52/778

(58) Field of Classification Search ..... 52/284, 52/762, 764, 777, 778, 779, 586.1, 586.2, 52/796.1, 745.09, 745.1, 770, 483.1, 763
See application file for complete search history.

(56) References Cited

U.S. PATENT DOCUMENTS

| | | | | | |
|---|---|---|---|---|---|
| 2,257,598 | A * | 9/1941 | Frease | 52/481.1 |
| 4,231,205 | A * | 11/1980 | Wendt | 52/481.1 |
| 4,567,699 | A * | 2/1986 | McClellan | 52/127.7 |
| 5,561,958 | A * | 10/1996 | Clement et al. | 52/407.1 |
| 5,577,356 | A * | 11/1996 | Hubbard et al. | 52/233 |
| 7,107,731 | B2 * | 9/2006 | Record | 52/309.9 |
| 7,762,033 | B2 * | 7/2010 | Scott et al. | 52/425 |
| 7,984,594 | B1 * | 7/2011 | Propst | 52/309.12 |
| 2004/0101649 | A1 | 5/2004 | Thoma | |
| 2007/0209305 | A1 | 9/2007 | Douglas | |
| 2008/0127606 | A1 * | 6/2008 | Kuroiwa | 52/784.14 |
| 2009/0193734 | A1 | 8/2009 | Harig et al. | |

FOREIGN PATENT DOCUMENTS

| | | | |
|---|---|---|---|
| DE | 19618847 | A1 | 11/1997 |
| JP | 2223442 | * | 9/1990 |
| JP | 05-106284 | A | 4/1993 |
| JP | 05-60836 | U | 8/1993 |
| JP | 3023057 | U | 1/1996 |
| JP | 11179826 | * | 7/1999 |
| JP | 2001-011982 | A | 1/2001 |
| JP | 2004-524200 | A1 | 8/2004 |
| JP | 2006-266073 | A | 10/2006 |
| JP | 2008-14111 | A | 1/2008 |
| JP | 2008014111 | * | 1/2008 |
| WO | WO 2005/038163 | * | 4/2008 |

* cited by examiner

*Primary Examiner* — Jessica Laux
(74) *Attorney, Agent, or Firm* — Sughrue Mion, PLLC

(57) ABSTRACT

A plurality of columns are erected with predetermined spacing on a groundsill. Then, a wall panel composed of a plurality of paulownia plates laminated, with the grains of the paulownia plates being crossed, is fixed between these columns. One surface of the wall panel is used as an external wall and the other surface of the wall panel is used as an internal wall to form the walls of the wooden house.

7 Claims, 9 Drawing Sheets

CONSTRUCTION METHOD FOR WOODEN HOUSE AND WALL PANEL

The entire disclosure of Japanese Patent Application No. 2009-246330 filed Oct. 27, 2009 is expressly incorporated by reference herein.

TECHNICAL FIELD

This invention relates to a construction method for a wooden house which is constructed by the framework construction method or the like, and a wall panel used therein.

BACKGROUND ART

A wooden house generally has a wall structure in which an external wall material forming an outdoor side wall of the house and an internal wall material forming an indoor side wall of the house are fixed to columns erected on a groundsill, and a heat insulating material, a waterproof sheet, etc. are disposed in a space between the external wall material and the internal wall material. The surface of the external wall material is finished, for example, in siding or mortar, and the surface of the internal wall material is finished, for example, with cloth hanging or the like.

With such a conventional construction method for a wooden house, all work for constructing walls, such as the work of fixing the external wall material and the internal wall material to the columns, and the work of filling the heat insulating material into the interior of the wall, are performed manually by carpenters or different builders at the construction site. Thus, the problems arise that the construction period is long, and accordingly the construction expenses are high.

In the house formed by the above construction method, problems, such that dew condensation causes fungi in the interior of the wall (the space between the external wall material and the internal wall material), or corrodes the column or the wall material, are likely to occur.

To solve such problems, a wall panel (building material) comprising the above-mentioned external wall material, internal wall material and heat insulating material integrated has found use in recent years. Various structures have been proposed for wall panels and, among them, there is, for example, a structure in which a high performance material is integrally provided between a first plate material and a second plate material, each made of Paulownia tomentosa (paulownia) (see Patent Document 1).

[Prior Technical Literature]

[Patent Document]

[Patent Document 1] JP-A-2008-14111

SUMMARY OF THE INVENTION

Problems to be Solved by the Invention

Construction of a wooden house with the use of such a wall panel may make it possible to shorten the construction period or cut down on the construction expenses, or to solve a problem such that dew condensation causes fungi. However, building materials using plate materials of paulownia as described in Patent Document 1, for example, have failed to obtain sufficient characteristics as external wall materials, and have been usable only as internal wall materials (including substrate materials). Moreover, the plate materials are likely to warp, for example, because of a change in the moisture content of the interior of the plate materials.

In recent years, global warming due to a greenhouse gas such as $CO_2$ has posed a problem. The utilization of wood, such as paulownia, for example, is effective in arresting global warming. Paulownia, for example, has the property of easily absorbing $CO_2$, as compared with other trees, in the growth stage. Thus, its planting can result in the absorption of $CO_2$ in large amounts. In planting paulownia, however, there is need to increase the amount of paulownia utilized. It is necessary, particularly, to increase the amount of utilization of relatively thin paulownia wood such as a timber from forest-thinning. Under the current situation, however, uses of paulownia wood are limited, and a great increase in a demand for paulownia cannot be expected. From the aspect of an environmental problem, such as global warming, therefore, it is desired that wood such as paulownia be effectively utilized, and a demand for it be expanded.

The present invention has been accomplished in the light of the above circumstances. It is an object of the present invention to provide a construction method for a wooden house and a wall panel which facilitate construction work, can cut down on the cost and can effectively suppress the occurrence of warping.

Means for Solving the Problems

A first aspect of the present invention for solving the above problems is a construction method for a wooden house, characterized by: erecting a plurality of columns with predetermined spacing on a groundsill; fixing a wall panel between the columns, the wall panel being composed of a plurality of paulownia plates laminated, with grains of the paulownia plates being crossed; and using one surface of the wall panel as an external wall and another surface of the wall panel as an internal wall to form the walls of the wooden house.

A second aspect of the present invention is the construction method for a wooden house according to the first aspect, characterized by fixing the wall panel to the columns, and then coating an infrared reflecting paint onto the one surface of the wall panel to form the external wall.

A third aspect of the present invention is the construction method for a wooden house according to the first or second aspect, characterized in that a concave portion is provided in each of an upper end surface and a lower end surface of the wall panel along a longitudinal direction of the wall panel, and a plurality of the wall panels are stacked, with an engagement member being engaged with the concave portion, to form the walls of the wooden house.

A fourth aspect of the present invention is the construction method for a wooden house according to any one of the first to third aspects, characterized in that the wall panel is formed by laminating a plurality of paulownia plywoods, each of the paulownia plywoods having a three-layer cross-bonded structure in which three paulownia plates are bonded together, with their grains being crossed, a direction of the grain of the inner paulownia plate being a transverse direction, and a direction of the grain of the outer paulownia plate being a longitudinal direction.

A fifth aspect of the present invention is the construction method for a wooden house according to any one of the first to fourth aspects, characterized in that a heat insulating portion surrounded by the paulownia plates constituting the wall panel is provided within the wall panel.

A sixth aspect of the present invention is a wall panel fixed to columns erected on a groundsill to form walls of a wooden house, characterized in that the wall panel comprises a plurality of paulownia plywoods laminated, each of the paulownia plywoods having a three-layer cross-bonded structure in which three paulownia plates are bonded together, with their grains being crossed, a direction of the grain of the inner paulownia plate being a transverse direction, and a direction of the grain of the outer paulownia plate being a longitudinal direction.

A seventh aspect of the present invention is the wall panel according to the sixth aspect, characterized by having a heat insulating portion which is a space surrounded by a plurality of the paulownia plywoods laminated.

An eighth aspect of the present invention is the wall panel according to the seventh aspect, characterized in that a plate-shaped heat insulating material is provided inside the heat insulating portion.

A ninth aspect of the present invention is the wall panel according to the seventh or eighth aspect, characterized in that a cable accommodation hole for accommodating various cables is provided independently of the heat insulating portion.

Effects of the Invention

According to the present invention, when a wooden house is constructed, construction work at the construction site becomes easy, so that the construction period can be shortened, and the construction expenses can be reduced. Furthermore, a wall structure excellent in various characteristics, such as refractoriness, yield strength, heat insulating properties, and watertightness, can be realized at a relatively low cost. Moreover, a wall panel effectively suppressing the occurrence of warping can be provided. Furthermore, such a wall panel using paulownia plates produces the effects of increasing a demand for wood such as paulownia, eventually suppressing global warming.

FIGS. [3A, 3B] Schematic views showing the construction method for a wooden house according to Embodiment 1 of the present invention.

Figure 4A:
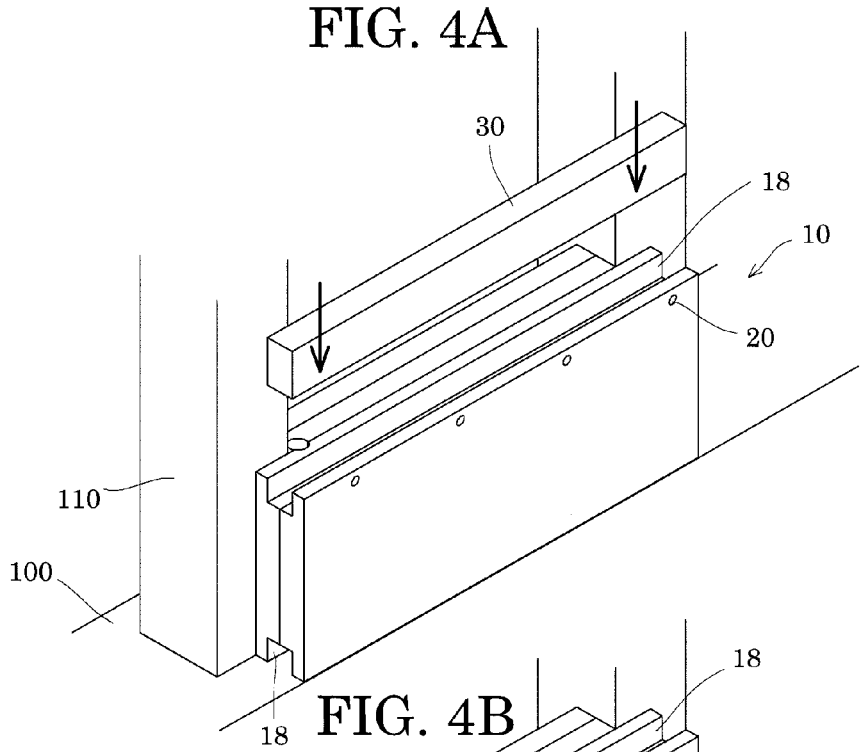
Figure 4B:
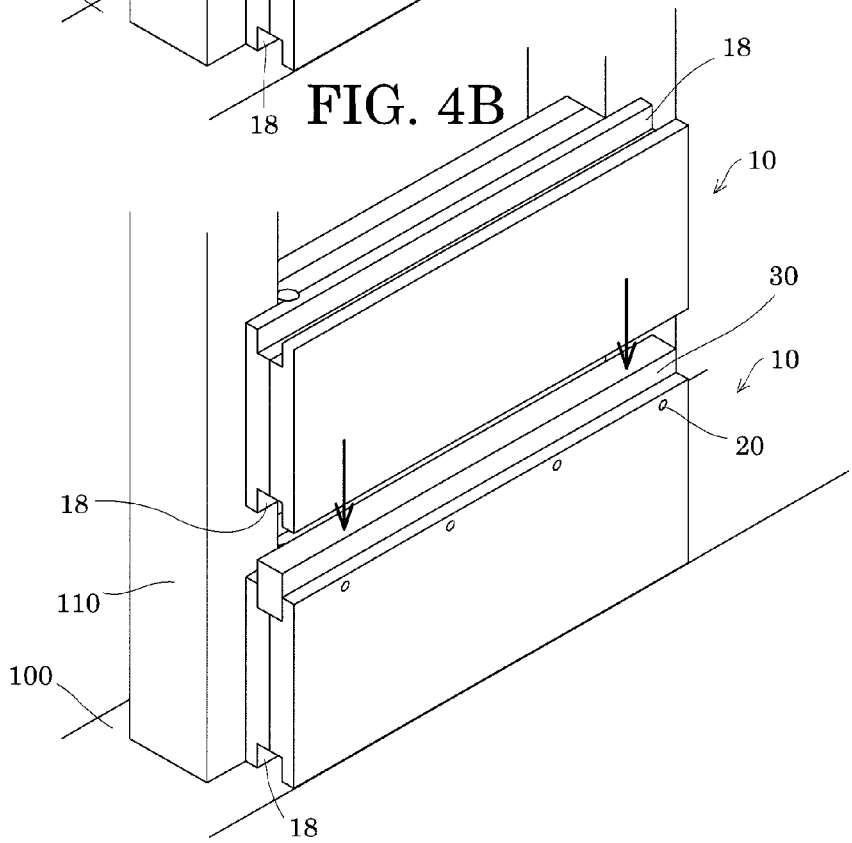

[FIGS. 4A, 4B] Schematic views showing the construction method for a wooden house according to Embodiment 1 of the present invention.

Figure 5:
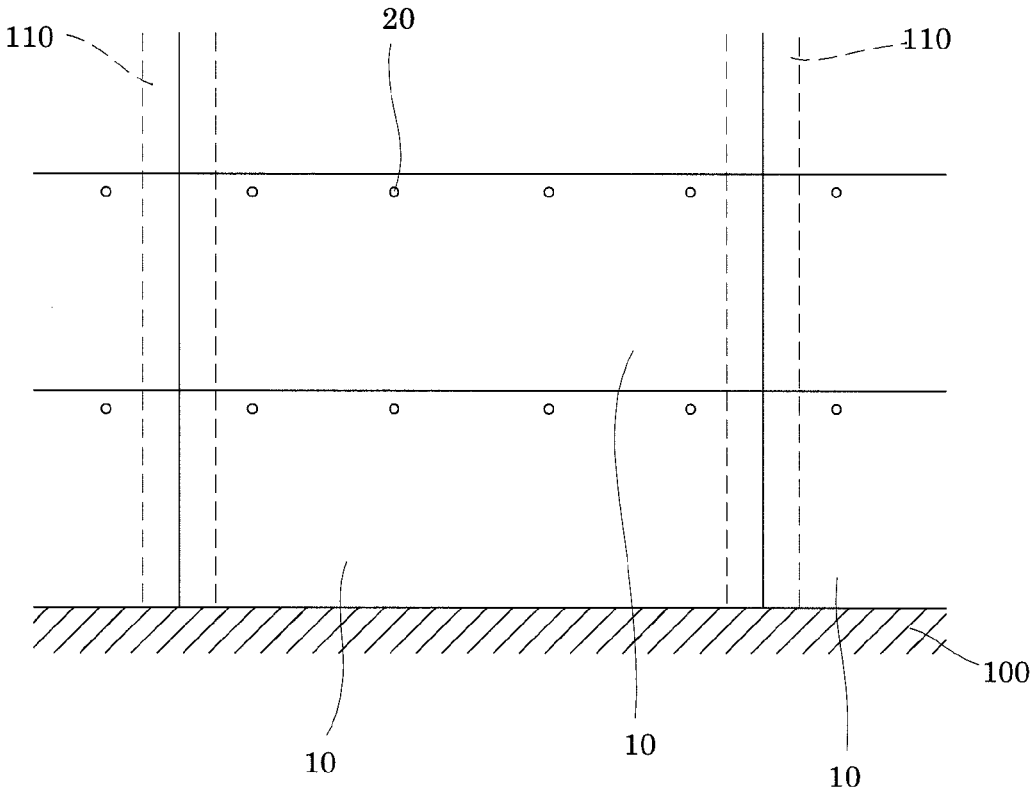

[FIG. 5] A plan view showing a wall structure using the wall panel according to Embodiment 1 of the present invention.

Figure 6:
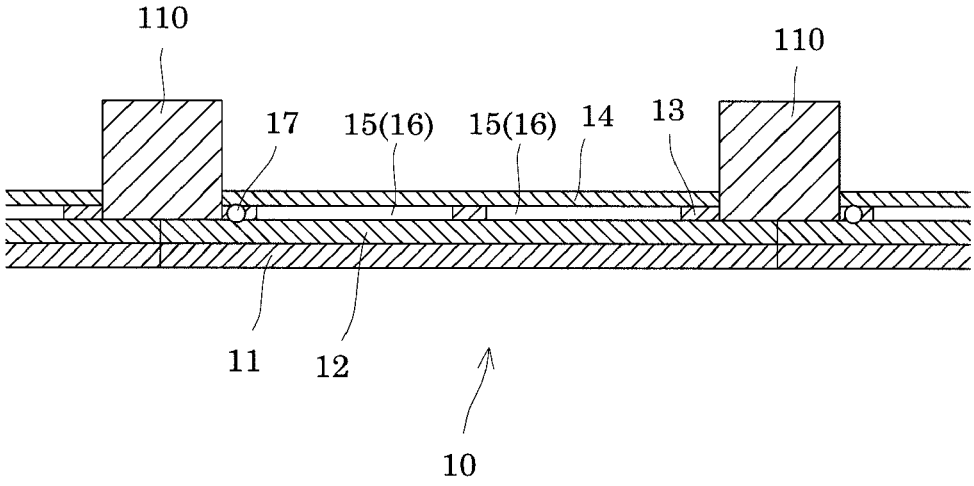

[FIG. 6] A transverse sectional view showing the wall structure using the wall panel according to Embodiment 1 of the present invention.

Figure 7:
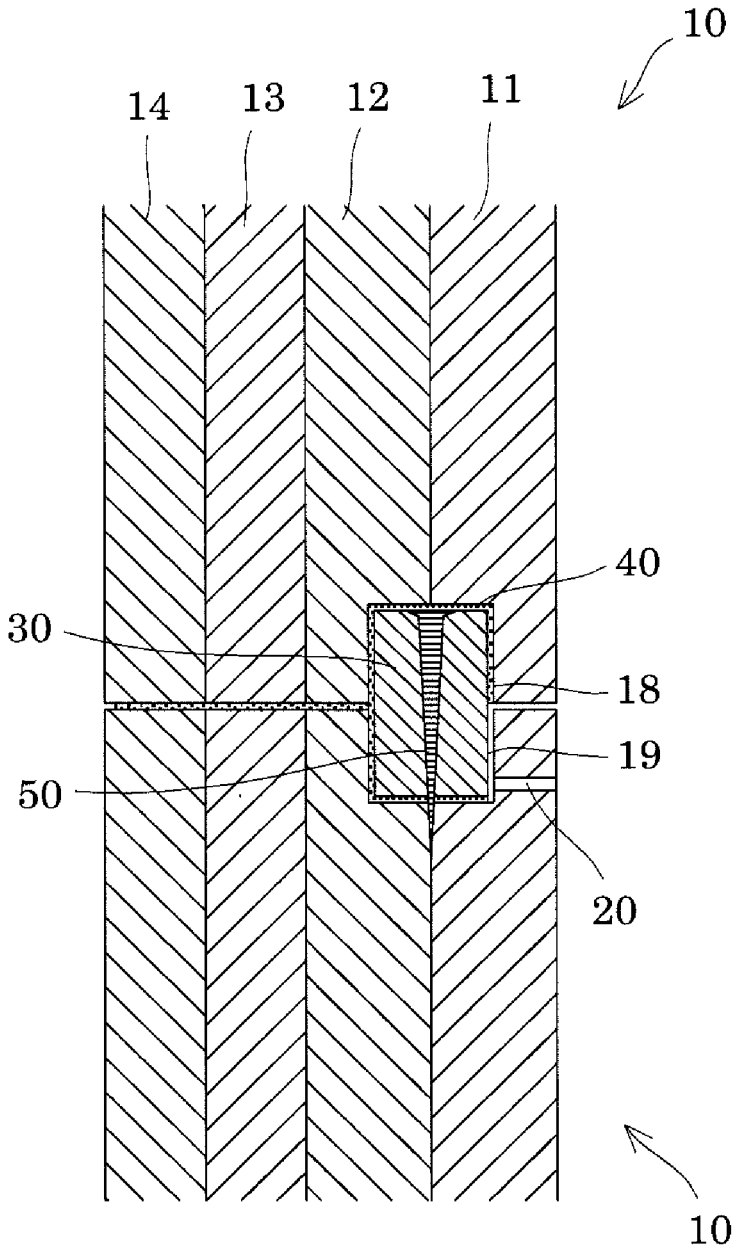

[FIG. 7] A longitudinal sectional view showing the wall structure using the wall panel according to Embodiment 1 of the present invention.

Figure 8:
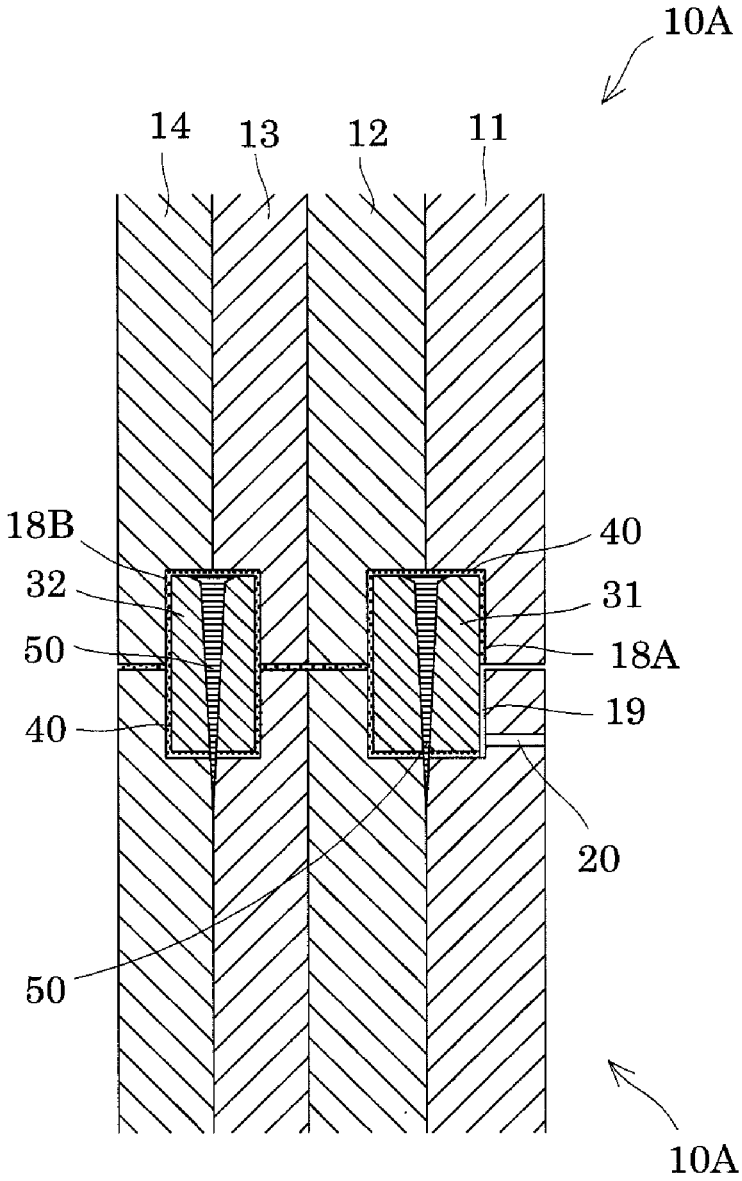

[FIG. 8] A longitudinal sectional view showing a wall structure using a wall panel according to Embodiment 2 of the present invention.

Figure 9:
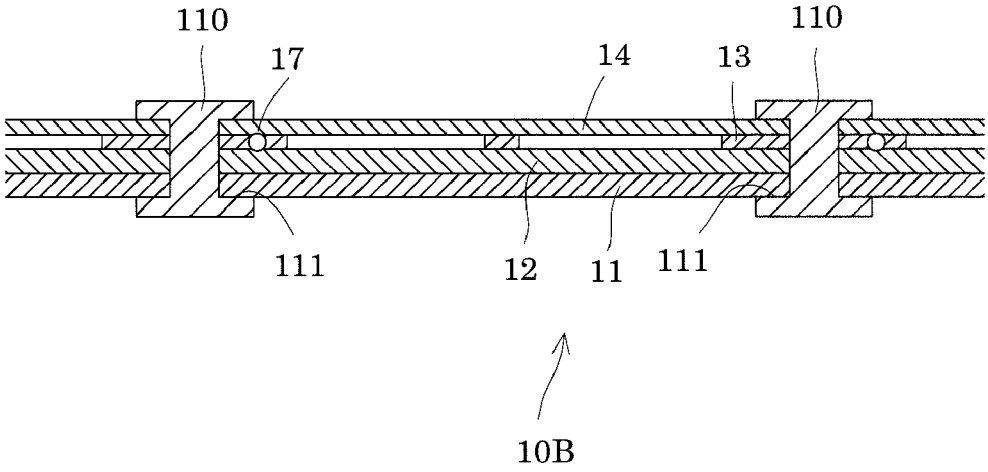

[FIG. 9] A transverse sectional view showing a wall structure using a wall panel according to Embodiment 3 of the present invention.

MODE FOR CARRYING OUT THE INVENTION

The present invention will be described in detail below based on its embodiments.

(Embodiment 1)

Figure 1:
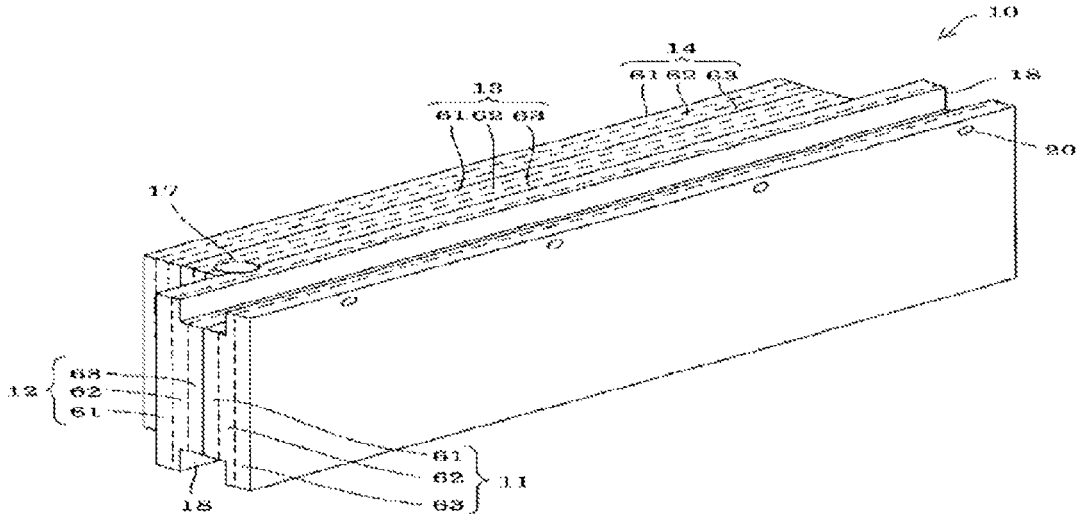
[FIG. 1] A perspective view of a wall panel according to Embodiment 1 of the present invention.

FIG. 1 is a perspective view showing a wall panel according to Embodiment 1 of the present invention. FIG. 2 is an exploded perspective view of the wall panel.

Figure 2A:
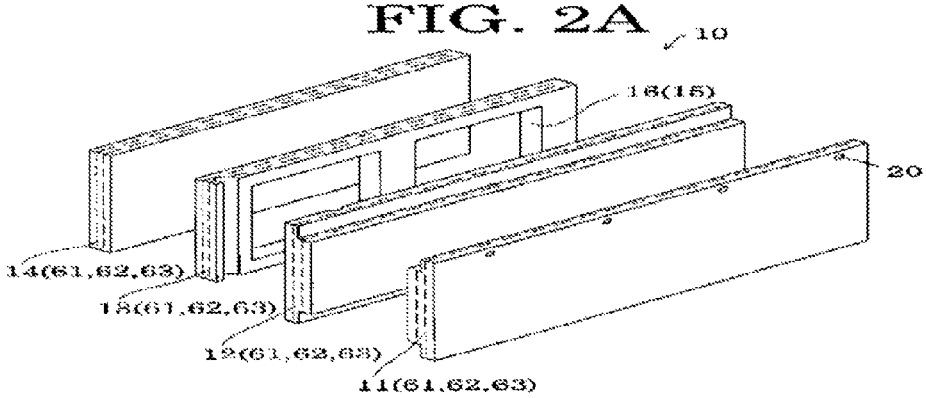
[FIGS. 2A, 2B] An exploded perspective view of the wall panel according to Embodiment 1 of the present invention.
Figure 2B:
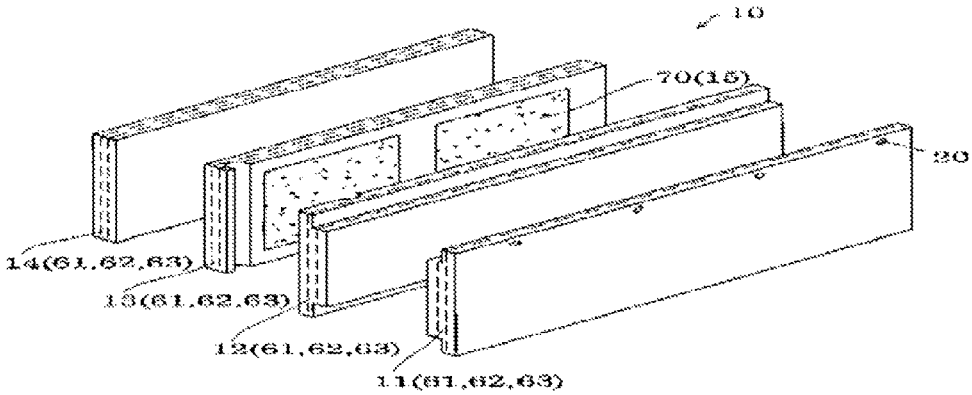

As shown in FIG. 1 and FIGS. 2A and 2B, a wall panel 10 according to the present invention is formed by laminating a plurality of paulownia plates. In the present embodiment, for example, the wall panel 10 is formed by laminating first to fourth paulownia plywoods 11 to 14, each plywood consisting of the plurality of (for example, three) paulownia plates 61, 62, 63 bonded together.

As details will be described later, the first paulownia plywood 11 constituting one side surface of the wall panel 10 becomes an external wall of a wooden house, while the fourth paulownia plywood 14 constituting the other side surface of the wall panel 10 becomes an internal wall of the wooden house.

The first to fourth paulownia plywoods 11 to 14 preferably have each of the paulownia plates composed of a laminated lumber, and have a three-layer cross-bonded structure in which the respective paulownia plates 61, 62, 63 are bonded together, with their grains being crossed. It is particularly preferred that the direction of the grain of the inner paulownia plate 62 be a transverse direction (transverse direction of the wall panel 10), and the direction of the grain of the outer paulownia plates 61, 63 be a longitudinal direction (longitudinal direction of the wall panel 10). If a single plate is used as the paulownia plate, sufficient strength may fail to be obtained.

The thicknesses of the first to fourth paulownia plywoods 11 to 14 are not restricted, but it is preferred that the thickness of the paulownia plywood on the external wall side be large. The thickness of each paulownia plate 61, 62, 63 constituting each of the first to fourth paulownia plywoods 11 to 14 is not restricted, but the thickness of the inner paulownia plate 62 is preferably equal to or greater than that of the outer paulownia plates 61, 63. For example, the first and second paulownia plywoods 11 and 12 on the external wall side are each composed of three 10 mm thick paulownia plates bonded together, and each have a thickness of 30 mm. On the other hand, the third and fourth paulownia plywoods 13 and 14 on the internal wall side are each composed of two 8 mm thick paulownia plates bonded to both sides of one 9 mm thick paulownia plate, and each have a thickness of 15 mm. That is, the wall panel 10 is formed to have a total thickness of 110 mm. The height of the wall panel 10 is 450 mm.

In the present embodiment, the wall panel 10 is composed of the four paulownia plywoods (the first to fourth paulownia plywoods 11 to 14). However, the number of the paulownia plywoods constituting the wall panel 10 is not restricted, and their number may be 3 or less, or 5 or more. For example, the wall panel 10 has the first to fourth paulownia plywoods 11 to 14 laminated, with the result that the wall panel 10 is composed of 12 paulownia plates. It goes without saying, however, that instead of laminating a plurality of the paulownia plywoods, it is permissible to compose the wall panel 10 of a single paulownia plywood consisting of 12 paulownia plates laminated, with their grains being crossed.

A heat insulating portion 15 surrounded by the paulownia plywoods (paulownia plates) constituting the wall panel 10 is provided inside the wall panel 10. Concretely, two opening portions 16 are provided in the third paulownia plywood 13, as shown in FIG. 2, and the heat insulating portion 15 is constituted by a sealed space surrounded with the third paulownia plywood 13, and the second paulownia plywood 12 and the fourth paulownia plywood 14 joined to both sides of the third paulownia plywood 13.

In the present embodiment , the heat insulating portion 15 is constituted by the sealed space surrounded with the second to fourth paulownia plywoods 12 to 14. However, a heat insulating material 70 may be provided within the heat insulating portion 15 (opening portion 16). In providing the heat insulating material 70, it is preferred, concretely, to use a plate-shaped heat insulating material , and configure this heat insulating material to be fitted into the opening portion 16. By so doing, the occurrence of a problem, such as the lopsidedness of the heat insulating material due to aged deterioration, is suppressed, and the heat insulating properties of the wall panel 10 are maintained satisfactorily for a long period of time. As the heat insulating material, NEOMA FOAM (Asahi Kasei Construction Material Corporation), for example, is suitably used. However, the type of the heat insulating material is not limited, and rock wool, for example, may be used.

The wall panel 10 composed of the first to fourth paulownia plywoods 11 to 14, namely, a plurality of paulownia plates laminated, as described above, is excellent in various characteristics, for example, heat insulating properties, refractoriness, and yield strength. The wall panel 10 can ensure heat insulating properties which can be adapted, for example, for cold districts and torrid districts throughout the world. Generally, paulownia wood is so soft that it is considered difficult to use as a building material. However, the wall panel 10 of the present invention, which comprises paulownia plywoods formed from laminated paulownia lumber, has sufficient strength as a building material. Furthermore, the wall panel 10 of such a structure is effectively inhibited from warping, so that the various characteristics mentioned above can be maintained satisfactorily for a long term. Incidentally, the "paulownia plate" referred to herein should be taken to include a plate material comprising falcata wood, as well as a plate material comprising paulownia wood. The paulownia wood or falcata wood is characterized in that both woods have the specific gravity of wood of 0.3 or less, and they minimally warp in comparison with other woods, and they are also lightweight.

As a material for a part of the wall panel 10, it is conceivable to use iron or the like, for example, thereby attempting to improve the characteristics. However, it is not preferred to adopt a material other than a paulownia plate. This is because if the material other than the paulownia plate is different in moisture content or coefficient of thermal expansion, a problem such that the wall panel 10 deforms may arise.

In the wall panel 10, a cable through-hole 17, in which cables such as an electric wire and a telephone line are disposed, is provided independently of the heat insulating portion 15. Thus, the cables can be arranged in an orderly manner, without impairing the function of the heat insulating portion 15. Even in a case where a heat insulating material is provided within the heat insulating portion 15, it is possible to arrange the cables in an orderly manner, without breaking the heat insulating material. There is also the effect that damage to the cables by rats, etc. can be prevented.

In each of the upper and lower end surfaces of the wall panel 10, a concave portion 18 is formed along the longitudinal direction of these surfaces. As will be described below, a plurality of the wall panels 10 stacked are coupled together by engagement members engaging the concave portions 18. By fixing the stacked wall panels 10 to columns erected on a groundsill, the walls of a wooden house excellent in various performance characteristics can be formed relatively easily.

Figure 3A:
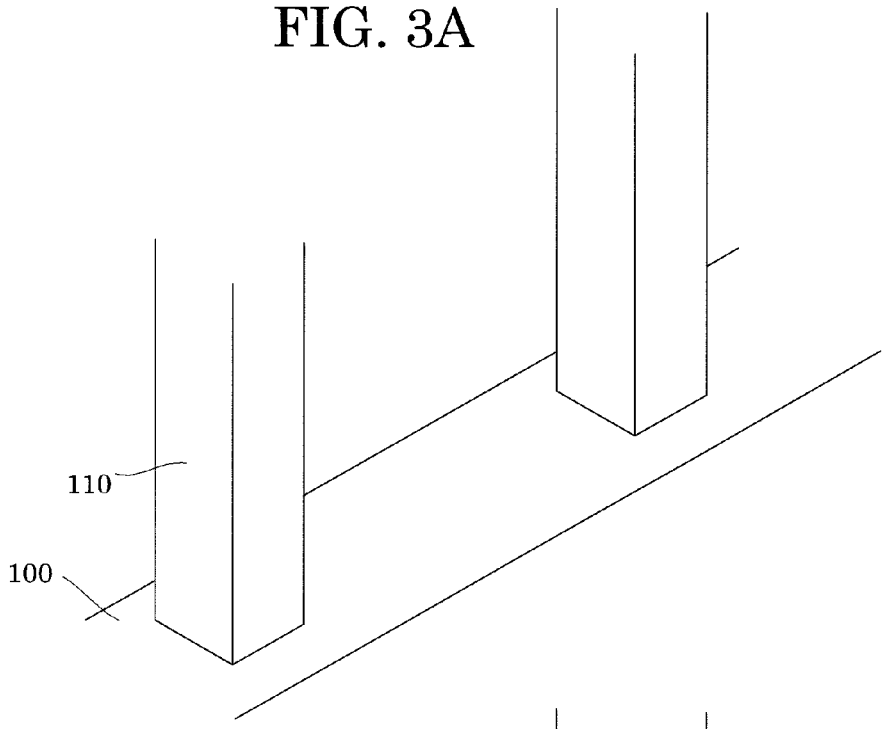
Figure 3B:
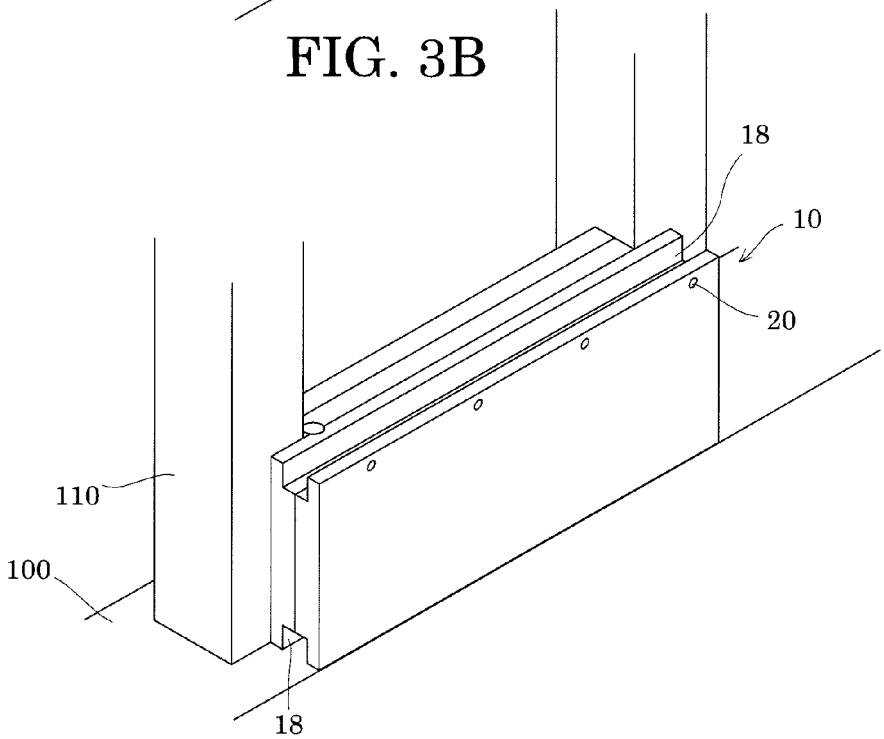

Concretely, as shown in FIG. 3A, columns 110 are erected with predetermined spacing on a groundsill 100, and other members, for example, cross-beams and beams, are used to form the frame (framework) of a building. Then, as shown in FIG. 3B, the single wall panel 10 is disposed between these columns 110, and is fixed to the respective columns 110 by nails or the like.

As mentioned above, the concave portions 18 are formed in the upper and lower end surfaces of the wall panel 10 along the longitudinal direction thereof. As shown in FIG. 4A, an engagement member 30 is fitted into the concave portion 18 formed in the upper end surface of the wall panel 10 fixed between the columns 110, and is fixed there. Then, as shown in FIG. 4B, the second wall panel 10 is overlaid on the first wall panel 10 and f fixed to the columns 110, with the engagement member 30 fixed to the first wall panel 10 being sandwiched between the first and second wall panels 10. That is, the engagement member 30 fixed to the first wall panel 10 is fitted into the concave portion 18 provided in the lower end surface of the second wall panel 10 and, in this state, the second wall panel 10 is fixed to the columns 110. Then, a plurality of the wall panels 10 are similarly overlaid one on another and fixed to the columns 110.

Then, the walls of a wooden house are formed, with one surface of the wall panel 10 fixed to the columns 110 serving as an external wall, and the other surface of this wall panel 10 serving as an internal wall. In the present embodiment, for example, each wall panel 10 is fixed to the columns 110, whereafter the surface of the first paulownia plywood 11 constituting the wall panel 10 is coated with an infrared reflecting paint, thereby using the side of the first paulownia plywood 11 of the wall panel 10 as the external wall. On the other hand, the surface of the fourth paulownia plywood 14 is subjected to work, such as that of sticking a wall paper to this surface, or that of coating an interior finishing material onto this surface, whereby the side of the fourth paulownia plywood 14 of the wall panel 10 is used as the internal wall. By these measures, the walls of the wooden house are formed.

According to the construction method of the present invention, as described above, the walls of the wooden house are formed by using the one surface of the wall panel 10 as the external wall and the other surface thereof as the internal wall. Thus, there is no need to make preparations for an external wall material and an internal wall material separately, as in the conventional technology, and the walls of the wooden house can be formed at a low cost.

Since each wall panel 10 has high strength, moreover, a wall formed of this wall panel 10 functions as a load-bearing wall. Thus, the number of studs or diagonal bracings can be reduced, making construction work easy and achieving cost reduction.

Furthermore, a plurality of the wall panels 10 are stacked to form the walls of the wooden house, thereby keeping the weight of the single wall panel 10 relatively light. For example, the weight of the wall panel 10 according to the present embodiment is kept down to a value of the order of 20 kg. Thus, the workforce necessary for construction work can be kept small, and the wall panel 10 can be handled relatively easily during transportation and at the construction site.

In the present embodiment, moreover, the surface of the wall panel 10, which serves as the external wall, is coated with the infrared reflecting paint, and the surface of the wall panel 10, which serves as the internal wall, is provided with the wall paper or the like. However, the infrared reflecting paint, the wall paper, etc. need not necessarily be provided.

A wall structure using the wall panel according to the present embodiment will be described below. FIG. 5 is a plan view showing a wall structure using the wall panel according to Embodiment 1. FIG. 6 is a transverse sectional view of the wall structure. FIG. 7 is a longitudinal sectional view showing a coupling portion for the wall panels in this wall structure.

In the wall structure according to the present embodiment, as shown in FIG. 5 and FIG. 6, a plurality of the wall panels 10 are stacked and, in this state, they are fixed to the columns 110 by the nails or the like to form the walls of the wooden house, as stated earlier. Thus, the first to fourth paulownia plywoods 11 to 14 constituting the wall panel 10 are formed in sizes conforming to the spacing between the columns 110. Specifically, the first and second paulownia plywoods 11 and 12 are formed with a width coincident with the distance between the centers of the adjacent columns 110, while the third and fourth paulownia plywoods 13 and 14 are formed with a width with which they are fitted between the adjacent columns 110. The wall panel 10 is fixed to the columns 110 by fixing members (not shown), such as nails or screws, from the side of the first paulownia plywood 11. In the present embodiment, for example, the distance between the centers of the columns 110 is 1,820 mm, the spacing between the columns 110 is 1,670 mm, and the first to fourth paulownia plywoods 11 to 14 are formed in sizes conforming to these dimensions.

As mentioned above, the concave portions 18 are formed in the upper and lower end surface of each wall panel 10. In the present embodiment, as shown in FIG. 7, the concave portion 18 is formed in the first and second paulownia plywoods 11 and 12, and the respective wall panels 10 are coupled together by the engagement member 30 engaged with the concave portion 18. The engagement member 30 comprises, for example, a square timber made of paulownia, and is adhered to the wall panel 10, which is located on the lower side, by an adhesive 40 and fixed thereto by a fixing member 50 such as a nail or a screw. The engagement member 30 is fixed to the upper wall panel 10 by the adhesive 40. That is, the engagement member 30 is fixed on the concave portion 18 in the upper surface of each wall panel 10, and the wall panels 10 having the engagement members 30 fixed thereto are stacked and fixed to the columns 110, whereby the walls of the wooden house are formed. The clearance between the wall panels 10 is sealed up with the adhesive 40 to ensure satisfactory watertightness.

Between the inner surface of the concave portion 18 facing the external wall side and the engagement member 30, there is formed a space portion 19 which is not coated with the adhesive 40 and which is a tiny gap continuous with the clearance between the stacked wall panels 10. Further, a communication hole 20 communicating with the space portion 19 is formed in the first paulownia plywood 11, and the space portion 19 is connected to the outside via the communication hole 20.

Since the space portion 19 and the communication hole 20 are provided in the wall panel 10, as mentioned above, in other words, since an isobaric drain is provided, watertightness can be increased further. That is, water (moisture) which has entered the clearance between the wall panels 10 from the outside flows into the space portion 19, and is discharged to the outside through the communication hole 20. Thus, the entry of water into the tiny gap in the part coated with the adhesive 40 toward the indoor side can be effectively suppressed.

In the present embodiment, as described above, a plurality of the wall panels 10 formed by the first to fourth paulownia plywoods 11 to 14 comprising the laminate of the plural paulownia plates are stacked to form the walls of the wooden house. Thus, the wall structure excellent in various characteristics, for example, heat insulating properties, refractoriness, and yield strength, can be realized. The wall panel 10 of the above-mentioned structure has, for example, a thermal resistance value of 2.0 $m^2k/w$, and ensures heat insulating properties which can be adapted for cold districts and torrid districts throughout the world. If the heat insulating material is used in the wall panel 10, the thermal resistance value can be adjusted very easily by adjusting the thickness of the heat insulating material. Furthermore, the wall panel 10 can suppress the occurrence of warping, and can maintain the above-mentioned characteristics satisfactorily for a long time. Increasing the thickness of the wall panel 10, for example, to a large thickness of the order of 130 mm, moreover, can obtain yield strength enough to make the columns unnecessary.

In the present embodiment, a plurality of the wall panels 10 are coupled together not by metals, but by the engagement members 30 comprising square timbers made of paulownia. Thus, the wall panels 10 are free from the problem of rust or corrosion for a long term.

In recent years, global warming has rapidly progressed, and the suppression and reduction of greenhouse gases such as $CO_2$ have been demanded. The wooden house using the wall panels 10 according to the present invention has excellent warmth retaining properties, and thus its effects of heating and cooling last for a long time. That is, its energy saving effect is so high that it is useful for greenhouse gas emission control.

Besides, paulownia, the material for the wall panel 10, has a very high rate of $CO_2$ absorption in the growth stage. Thus, cultivation of many paulownia trees, for example, by tree planting is effective for cutting down greenhouse gases. However, as paulownia grows to some extent, its $CO_2$ absorption rate gradually decreases. Thus, it is desirable to repeat cutting down and replanting of the trees on relatively quick cycles. By so doing, a very large amount of $CO_2$ is absorbed by paulownia. Currently, however, there are very few uses of relatively thin paulownia wood such as a timber from forest-thinning, and an increase in a demand for it is not expected. Thus, a quick cycle of paulownia planting, as mentioned above, has not been realized.

In the wall panel 10 according to the present invention, as described above, a laminated lumber of paulownia is suitably used as a material for it. Thus, the adoption of the wall panel 10 of the present invention in wooden houses is expected to increase a demand for paulownia remarkably. If a solution to the problem of a small demand for paulownia achieves the above-mentioned quick planting cycle, $CO_2$ will be markedly cut down. The present invention, as stated above, is of very great use which is eventually useful in improving the global environment.

(Embodiment 2)

FIG. 8 is a view showing a wall structure using a wall panel according to Embodiment 2.

The present embodiment is an example in which respective wall panels are coupled together by two engagement members. The other features are the same as those in Embodiment 1. Specifically, a first concave portion 18A and a second concave portion 18B are provided in each of upper and lower end surfaces of a wall panel 10A according to the present embodiment, as shown in FIG. 8. The first concave portion 18A is formed in first and second paulownia plywoods 11 and 12, while the second concave portion 18B is formed in third and fourth paulownia plywoods 13 and 14. In the present embodiment, the thicknesses of the first and second paulownia plywoods 11 and 12 are larger than the thicknesses of the third and fourth paulownia plywoods 13 and 14. In correspondence with these dimensions, the width of the first concave portion 18A is larger than the width of the second concave portion 18B. It goes without saying that these widths of the first concave portion 18A and the second concave portion 18B are not limitative. The respective wall panels 10A are coupled by a first engagement member 31 engaged with the first concave portion 18A and joined thereto by an adhesive 40, and a second engagement member 32 engaged with the second concave portion 18B and joined thereto by the adhesive 40.

With such a configuration, the wall panels 10A are coupled to each other more firmly. Thus, the strength of the wall is further enhanced. Moreover, the areas of adhesion of the first and second engagement members 31 and 32 to the wall panels 10A increase, so that the penetration of moisture from the outdoor side into the indoor side is suppressed more reliably.

(Embodiment 3)

FIG. 9 is a view showing a wall structure using a wall panel according to Embodiment 3.

The present embodiment is another example of a structure for fixing the wall panel to the column 110. That is, in Embodiment 1, the third and fourth paulownia plywoods 13 and 14 are fitted between the columns 110, while the first and second paulownia plywoods 11 and 12 are fixed to the outside surfaces of the columns 110. In the present embodiment, as shown in FIG. 9, each column 110 has guide grooves 111 formed in its surfaces opposing the adjacent columns 110, and a wall panel 10B is fitted into the guide grooves 111, whereby the wall panel 10B is fixed to the columns 110. The first and second paulownia plywoods 11, 12 and the third and fourth paulownia plywoods 13, 14, which constitute the wall panel 10B according to the present embodiment, are formed with the same width in agreement with the length between the opposed guide grooves 111.

Such a configuration also enables the wall structure excellent in various characteristics as mentioned above to be realized at a relatively low cost.

The embodiments of the present invention have been described above, but it is to be noted, needless to say, that the present invention is not limited to these embodiments, if its scope does not depart from the gist of the invention.

[Description Of The Reference Numerals]

10 Wall panel
11 First paulownia plywood
12 Second paulownia plywood
13 Third paulownia plywood
14 Fourth paulownia plywood
15 Heat insulating portion
16 Opening portion
17 Cable through-hole
18 Concave portion
19 Space portion
20 Communication hole
30 Engagement member
31 First engagement member
32 Second engagement member
40 Adhesive
50 Fixing member

The invention claimed is:

1. A wall panel fixed to columns erected on a groundsill to form walls of a wooden house, characterized in that the wall panel comprises a plurality of paulownia plywoods laminated, each of the paulownia plywoods having a three-layer cross-bonded structure in which three paulownia plates are bonded together, with their grains being crossed, a direction of the grain of the inner paulownia plate being a transverse direction, and a direction of the grain of the outer paulownia plate being a longitudinal direction, wherein the plurality of wall paulownia plywoods includes a first paulownia plywood, a second paulownia plywood, a third paulownia plywood and a fourth paulownia plywood laminated in the recited order, wherein the first and second paulownia plywoods have a width coincidence with a distance between centers of adjacent columns, and the third and fourth paulownia plywoods have a width which is wider than the width of the first and second paulownia plywoods.

2. The wall panel according to claim 1, characterized by having a heat insulating portion which is a space surrounded by a plurality of the paulownia plywoods laminated.

3. The wall panel according to claim 2, characterized in that a plate-shaped heat insulating material is provided inside the heat insulating portion.

4. The wall panel according to claim 2, characterized in that a cable accommodation hole for accommodating various cables is provided independently of the heat insulating portion.

5. The wall panel according to claim 1, wherein the fourth paulownia plywood forms an external wall.

6. The wall panel according to claim 1, wherein the third and fourth paulownia plywoods form a concave portion on each of a top surface and a lower surface of the wall panel.

7. The wall panel according to claim 1, wherein an insulating material is disposed within an opening portion formed in the third paulownia plywood.

* * * * *